US008585369B2

(12) United States Patent
Aubin et al.

(10) Patent No.: US 8,585,369 B2
(45) Date of Patent: Nov. 19, 2013

(54) DEVICE FOR AXIAL RETENTION OF MOBILE VANES MOUNTED ON A ROTOR DISC

(75) Inventors: Stephan Yves Aubin, Brussels (BE); Erick Jacques Boston, Cesson (FR); Yvon Cloarec, Ecuelles (FR)

(73) Assignee: SNECMA, Paris (FR)

( * ) Notice: Subject to any disclaimer, the term of this patent is extended or adjusted under 35 U.S.C. 154(b) by 573 days.

(21) Appl. No.: 12/937,894

(22) PCT Filed: Apr. 24, 2009

(86) PCT No.: PCT/FR2009/000489

§ 371 (c)(1),
(2), (4) Date: Oct. 14, 2010

(87) PCT Pub. No.: WO2010/122235

PCT Pub. Date: Oct. 28, 2010

(65) Prior Publication Data

US 2011/0123341 A1 May 26, 2011

(30) Foreign Application Priority Data

Apr. 24, 2008 (FR) ..... 08 02292

(51) Int. Cl.
*F01D 5/02* (2006.01)

(52) U.S. Cl.
USPC ..... 416/221; 416/220 R

(58) Field of Classification Search
USPC ..... 416/218, 219 R, 220 R, 221
See application file for complete search history.

(56) References Cited

U.S. PATENT DOCUMENTS

| | | | | |
|---|---|---|---|---|
| 3,039,739 | A * | 6/1962 | Leland | 416/222 |
| 4,221,542 | A * | 9/1980 | Acres et al. | 416/220 R |
| 4,682,934 | A * | 7/1987 | Knorowski et al. | 416/198 A |
| 4,730,983 | A * | 3/1988 | Naudet et al. | 416/220 R |
| 4,767,276 | A | 8/1988 | Barnes et al. | |
| 5,320,492 | A | 6/1994 | Bouru et al. | |
| 5,330,324 | A | 7/1994 | Agram et al. | |

(Continued)

FOREIGN PATENT DOCUMENTS

| | | |
|---|---|---|
| EP | 1 355 044 | 10/2003 |
| FR | 2 603 333 | 3/1988 |

(Continued)

OTHER PUBLICATIONS

International Search Report issued Oct. 12, 2009 in Application No. PCT/FR2009/000489 (With English Translation).

(Continued)

*Primary Examiner* — Edward Look
*Assistant Examiner* — Christopher R Legendre
(74) *Attorney, Agent, or Firm* — Oblon, Spivak, McClelland, Maier & Neustadt, L.L.P.

(57) ABSTRACT

A device for axial retention of mobile vanes mounted on a rotor disc includes two open rings, superimposed. At least one of the rings includes a rotating stop mechanism configured to cooperate with at least one hook of the disc. The two open rings are mounted in a discontinuous groove formed in the hooks, at the end of teeth situated on the periphery of the rotor disc, such that the rotating stop mechanism of the first ring is placed in the opening of the second ring. The significance of contact surfaces between the two rings allows a damping of vibrations during operation.

11 Claims, 4 Drawing Sheets

(56) References Cited

U.S. PATENT DOCUMENTS

| | | | | |
|---|---|---|---|---|
| 5,582,077 | A * | 12/1996 | Agram et al. | 464/180 |
| 6,846,159 | B2 * | 1/2005 | Zabawa et al. | 416/2 |
| 7,258,529 | B2 * | 8/2007 | Wagner | 416/220 R |
| 7,290,988 | B2 * | 11/2007 | Boston et al. | 416/220 R |
| 8,226,366 | B2 * | 7/2012 | Brucher et al. | 416/221 |
| 2003/0194319 | A1 | 10/2003 | Zabawa et al. | |
| 2004/0184919 | A1 | 9/2004 | Zabawa et al. | |
| 2005/0232760 | A1 | 10/2005 | Wagner | |
| 2011/0123341 | A1 * | 5/2011 | Aubin et al. | 416/220 R |
| 2012/0063907 | A1 * | 3/2012 | Cloarec | 416/220 R |

FOREIGN PATENT DOCUMENTS

| | | |
|---|---|---|
| FR | 2 608 694 | 6/1988 |
| FR | 2 694 046 | 1/1994 |
| FR | 2 695 433 | 3/1994 |
| FR | 2 729 709 | 7/1996 |
| GB | 2 410 984 | 8/2005 |

OTHER PUBLICATIONS

Preliminary Search Report issued Nov. 11, 2008 in France Application No. 0802292 (With English Translation of Category of Cited Documents).

* cited by examiner

Cross-section A-A

DEVICE FOR AXIAL RETENTION OF MOBILE VANES MOUNTED ON A ROTOR DISC

The present invention relates to the field of the axial retention of the mobile vanes mounted on a rotor of a turbomachine such as an airplane turbojet engine or turbo-prop.

As described in documents FR 2 729 709, FR 2 694 046 and FR 2 603 333, it is known for a turbomachine rotor to be equipped with a disc, mobile vanes supported by the disc and at least one retaining ring to prevent displacement of the mobile vanes in the axial direction, the axial direction being defined by the axis of rotation of the turbomachine.

Document FR 2 729 709 describes a device for retaining turbomachine rotor vanes including a slit lock ring and equipped with at least one anti-rotation stop. The lock ring is housed in a circular groove formed by hooks of the vanes and disc.

This device has the drawback of requiring precise machining of the anti-rotation stops and the hooks situated at the end of the teeth of the disc. Moreover, in certain operating configurations of the turbomachines, a disengagement of the lock ring may occur under the effect of significant vibrations and/or thermal and dynamic stresses and lead to the deterioration of the device.

Document FR 2 694 046 proposes using a device for retaining the foot of the turbomachine rotor blades made up of two rings, one of which is a slotted flange, elastic, equipped with a plurality of protuberances for stopping rotation, and the other of which is a lock ring for maintaining the flange in its mounted position.

This device has the drawback of requiring protuberances either on the rings or on the rotor disc, these protuberances being difficult and costly to produce.

Document FR 2 603 333 proposes using a first segment to ensure the sealing between the upstream and downstream of a rotor disc and a second segment ensuring the retention of the vanes on that rotor disc.

This device has the drawback that no anti-rotation means is provided for the second segment, a free end of which can disengage from the groove of the disc, causing the complete disengagement of the ring and the possible deterioration of the device and/or of the rotor disc.

It is also known to use a device for retaining vanes as illustrated in FIG. 2.

In this figure, a rotor disc 1 includes a disc body 2, a plurality of teeth 3 and slots 4, alternatingly distributed on its circumference and extending in the axial direction. Each tooth 3 is provided with at least one hook 5, protruding in the axial direction of the disc, which defines, on said tooth, an elementary groove opening radially inward. The foot 7 of a vane 8 is inserted into a slot 4 and blocked axially by a ring 9, housed in a discontinuous groove 6, formed by the succession of elementary grooves. The retaining ring 9 is provided with a slit 30, separating the two free ends 31, 32 of the ring. The slit 30 allows the closing of the ring 9 and the decrease of its outer diameter necessary for the placement of the ring 9 in the groove 6. The two free ends 31, 32 are equipped with stops 36 and 37 that cooperate with a stop-hook 35 to stop the rotation of the ring and guarantee the presence of the slit 30 under the stop-hook 35 in order to ensure that the free ends of the ring 9 are kept under said stop-hook 35.

This device has the drawbacks of needing a precise machining of the stop-hook 35 and, in certain operating configurations of the turbomachine, under significant dynamic and thermal stresses, of causing the jamming of the stop-hook 35 between the stops 36 and 37, and causing disengagement of the lock ring 9 from the groove 6 and the deterioration of the retaining device. The vibrations due to the different set points of the turbomachine can also cause significant wear of the retaining device and/or promote the disengagement of a free end of the ring outside the groove. When the play between the lateral support faces of the stops 36, 37 and the lateral faces of the stop-hook 35 is small, mounting the ring can also be difficult.

The aim of the invention is to realize a device for axial retention of mobile turbomachine vanes not having the drawbacks of the known devices and making it possible to resolve the problem of disengagement during operation of the retaining device.

To do this, according to the invention, the device for axial retention of mobile vanes, designed to be inserted in a discontinuous groove of a turbomachine rotor disc, includes two rings, superimposed, each having an opening separating free ends of the ring, at least the first ring being provided with a rotation stop means provided to engage in the opening of the second ring, such that the two rings form a double ring. The use of two rings, which cooperate with each other, makes it possible to ensure the axial retention of the mobile vanes on the entire double ring in particular, at the opening of one of the rings. The superposition of the two rings makes it possible, due to the significance of the surfaces in contact, to damp the operating vibrations and thereby decrease the risks of disengagement of one of the rings from the groove.

Preferably, the two rings have a same width, same thickness and identical outer diameter, which facilitates the provision of steel and the storage.

Preferably, the rotation stop means protrudes outwardly, in a radial direction of the first ring.

Preferably, the rotation stop means of the first ring is a brace, formed by a tab, bent, folded down and fixed on a face of the first ring.

According to a first variant of the rotation stop means, the brace is machined in an oversize of the first ring.

According to a second variant of the rotation stop means, the brace includes an inter-tooth lug for stopping rotation protruding radially toward the outside of the first ring.

Alternatively, according to a third variant of the rotation stop means, the inter-tooth lug has a thickness equal to twice that of the rest of the ring.

Preferably, the brace and the opening of the first ring are spaced angularly by an angle greater than 150°. The brace and the opening are then approximately diametrically opposite one another relative to the axis of rotation of the rotor.

Alternatively, the second retaining ring also includes a rotating brace stop.

The invention also concerns a turbomachine rotor including at least one rotor disc whereof the body is equipped with a plurality of slots and teeth provided with at least one hook, protruding in the axial direction of the disc, which defines, on that tooth, an elementary groove opening radially inwardly, the foot of a vane being inserted into the slot and stopped in translation in the slot by at least one axial retaining device as defined above for mobile vanes, placed in a discontinuous groove, formed by the succession of said elementary grooves.

The invention also concerns a turbomachine including a rotor as defined above.

The invention will be better understood and other advantages thereof will appear more clearly in light of the description provided as a non-limiting example and done in reference to the appended drawings, in which.

Figure 2:
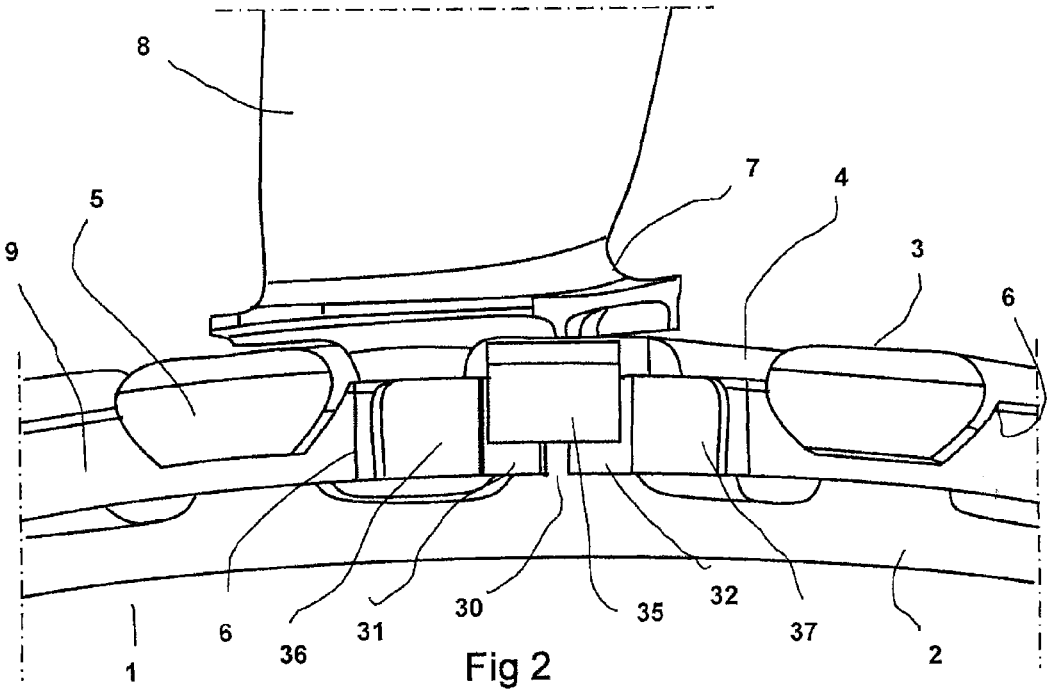
Fig 2 PRIOR ART
FIG. 2 illustrates an axial retaining device for mobile vanes according to the prior art.

The references of FIG. 2, already commented on and used in the following figures, correspond to elements similar to those of the prior art and will only be described briefly.

Figure 1:
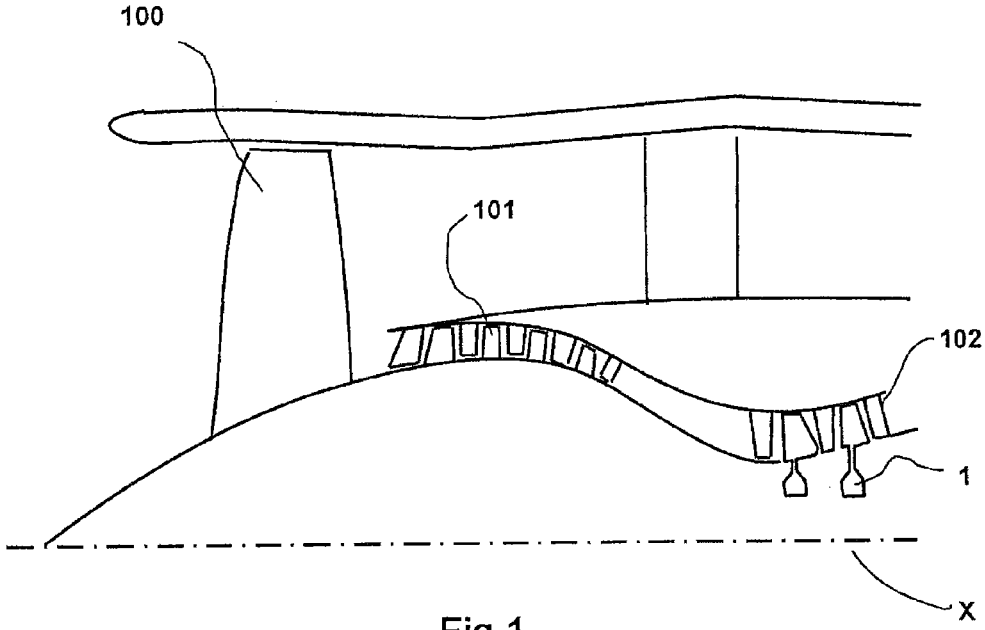
FIG. 1 shows a partial cross-sectional, diagrammatic view of a turbomachine.

FIG. 1 shows a diagrammatic cross-sectional view of an example of turbomachine compressor with axis X including, from upstream to downstream, in a direction of airflow through the turbomachine, a fan 100, a low-pressure compressor 101 and a high-pressure compressor 102. The high- and low-pressure parts of the compressor include at least one disc 1 mobile in rotation around the axis X. A plurality of vanes are mounted on the circumference of the disc.

Figure 3:
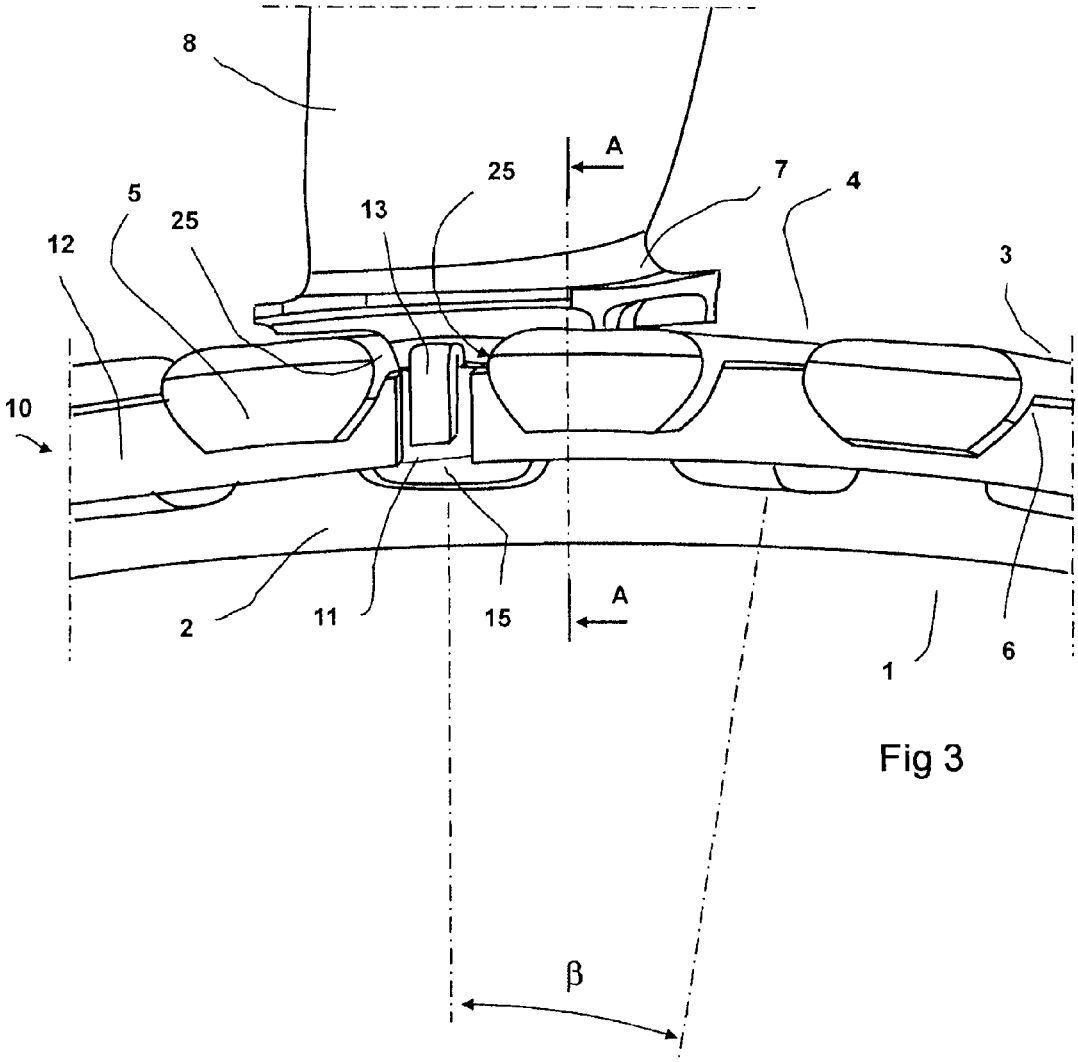
FIG. 3 illustrates a device for axial retention of mobile vanes according to a first embodiment of the invention.

FIG. 3 shows an example of a device for retaining vanes according to the invention. This figure shows a portion of rotor disc 1 including a plurality of teeth 3, alternating with slots 4, regularly distributed on its circumference. The teeth 3 extend in the axial direction and include, protruding in the axial direction of the disc, at their ends, hooks 5. The foot 7 of the vane 8 is engaged in a slot 4.

A double ring 10, mounted in a discontinuous groove 6, defined by the hooks 5 of the disc 1, allows the axial retention of the vanes 8 toward the upstream and/or downstream of the turbomachine. The double ring 10 includes two open rings 11, 12, superimposed, the first ring being equipped with a rotating brace stop 13, extending outwardly in the radial direction of the rotor disc 1.

The first ring 11 includes a first face in contact with the disc 1 and a second face in contact with the second ring 12. The brace 13 is positioned on the face of the first ring 11 in contact with the second ring 12. The second open ring 12 is mounted such that its opening 15 frames the brace 13 of the first ring.

The brace 13 of the first ring 11 has a width significantly smaller than the space separating two successive hooks 5.

Figure 4:
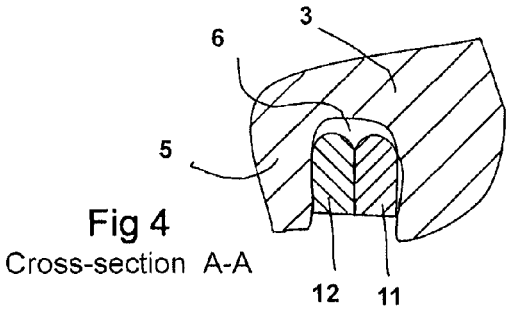
FIG. 4 is a view along cross-section A-A of FIG. 3.

FIG. 4 shows a cross-sectional view along line A-A of FIG. 3, of the assembled double ring 10, made up of the rings 11 and 12 superimposed and mounted in the groove 6.

Figure 5:
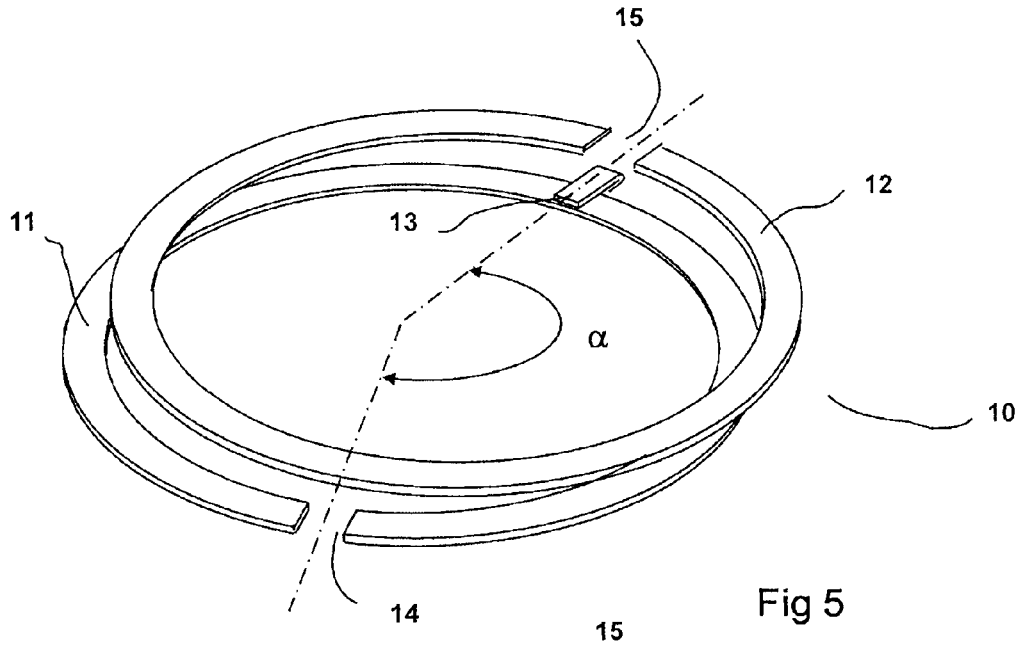
FIG. 5 illustrates first and second rings in their assembly position according to a first embodiment of the invention.

According to a first embodiment of the invention, the double ring 10, shown in perspective in FIG. 5, is made up of a first ring 11 equipped with a rotating brace stop 13 and a second simple ring, without brace. In this case, the second ring 12 has no favored mounting direction.

The first and second rings 11, 12 are preferably obtained in a metal sheet. The brace 13 protrudes on one hand on the face 18 of the first ring and on the other hand, in the radial direction, toward the outside of the circumference of the first ring 11.

The opening 14, 15 of each ring 11, 12 is large enough to allow the easy superposition of the rings 11, 12 one on the other and to eliminate jamming problems during operation and the disengagement of one of the rings 11, 12 from the groove 6.

The width of the opening 15 of the second ring 12 is larger than the width of the brace 13 of the first ring 11. One easily understands from FIG. 5 that the significance of the surfaces, in planar contact, of the rings 11, 12 makes it possible to ensure, by the friction created, a function of damping vibrations during operation.

The brace 13 and the opening 14 of the first ring 11 are angularly spaced by an angle $\alpha$. The angle $\alpha$ is not a whole multiple of the angle $\beta$ formed between two successive notches 5 of the disc 1.

Figure 6:
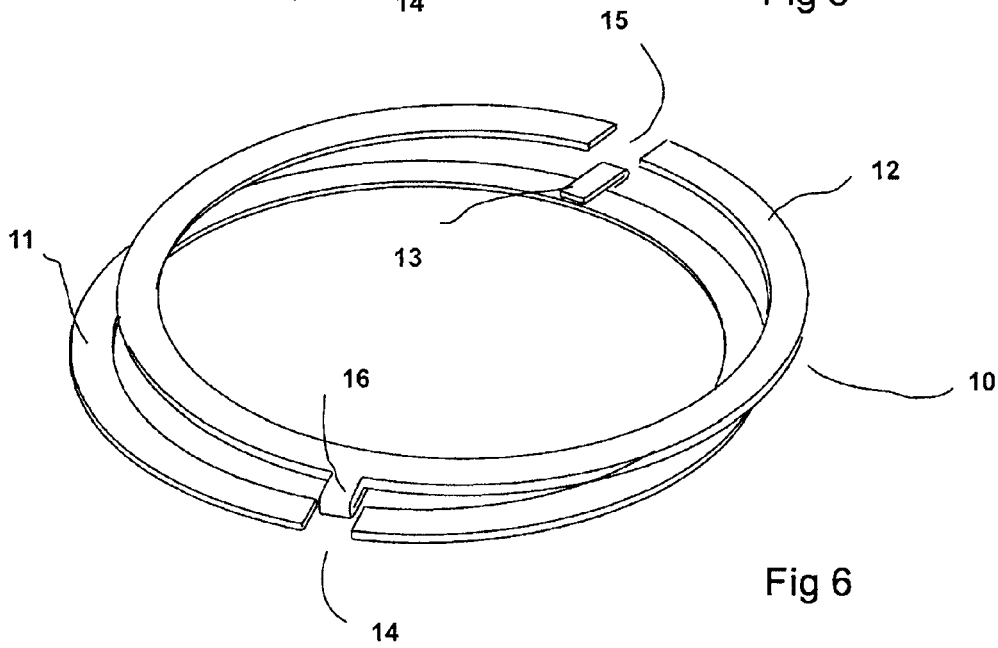
FIG. 6 illustrates first and second rings in their assembly position according to a second embodiment of the invention.

FIG. 6 shows a double ring 10, according to a second embodiment of the invention. According to this embodiment, each of the two rings 11, 12 is equipped with a rotating brace stop 13, 16, respectively. The brace 13 of the first ring 11 is placed in the opening of the second ring 12. The brace 16 of the second ring is placed in the opening 14 of the first ring 11.

In the continuation of the description, each embodiment of the rotating stop means 13 of the first ring 11 may be applied to the rotating stop means 16 of the second ring 12.

The presence of the brace 16 on the second ring 12 advantageously participates in the dynamic balancing of the double ring 10 through better distribution of the masses and participates in reducing stresses on the rotating stop braces 13, 16.

Figure 7:
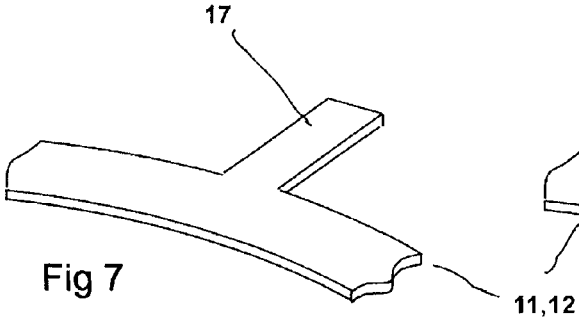
FIGS. 7 and 8 show two partial views of the first ring provided with a stop according to the invention, during realization.
Figure 8:
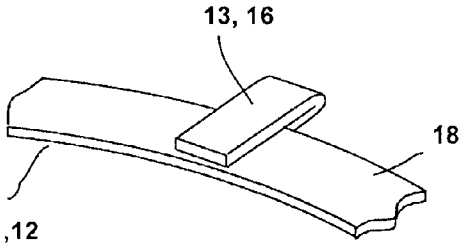

FIGS. 7 and 8 show a first embodiment of a brace according to the invention. The brace 13, 16 is obtained for example by punching in a metal sheet, so as to cause a tab 17 to appear. The tab 17 extends in the radial direction toward the outside of the ring 11, 12 over a sufficient length to be bent, folded down and fixed, for example by brazing, on a face 18 of the ring and to thereby form a brace 13, 16.

Figure 9:
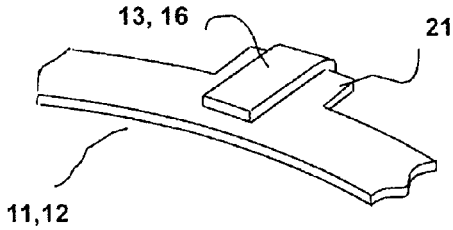
FIGS. 9 to 11 show alternative embodiments of the stop according to the invention.
Figure 10:
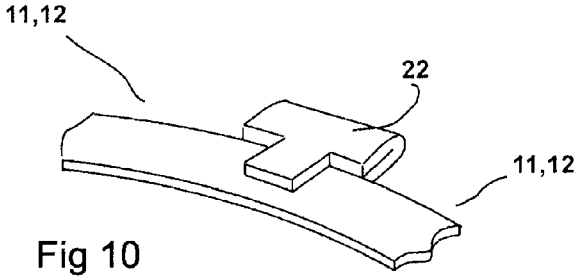

FIGS. 9 and 10 illustrate first and second variants of the brace 13, 16 according to the invention. The brace 13, 16 includes a tab 17 and an inter-tooth lug 21, 22 that can advantageously be obtained during a cutting operation of the sheet, for example by punching. The tab 17 and the inter-tooth lug 21, 22 extend in the radial direction protruding toward the outside of the ring 11, 12. The width of the inter-tooth rotating stop lug 21, 22 is smaller than the space separating two lateral faces 25 facing two successive teeth 5 of the rotor disc 1 receiving the mobile vanes 8. The inter-tooth lug ensures the rotational stop of the double ring while allowing a rotation of small amplitude of the first ring 11, for example less than 3°.

The thickness of the inter-tooth lug 22 being equal to twice that of the rest of the ring 11, 12, the rotational stop stresses of the double ring and the risks of flaws in the braze 24 are decreased.

Figure 11:
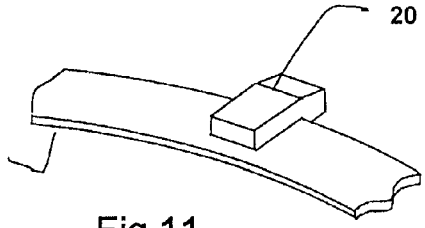

FIG. 11 illustrates a third variant of a brace 20. The brace 20 is machined in one piece (not shown) including an oversize and fixed on the ring 11 before the opening 14 is formed. This piece is fixed, preferably by welding. Such an operating method makes it possible to obtain the majority of the ring thus defined from sheet metal having a small thickness.

These embodiments of the double ring 10 and the variant embodiments of the brace make it possible to obtain ring openings 14, 15 with dimensions larger than those of the prior art, and to ensure axial retention of the mobile vanes 8, continuous over the entire periphery of the disc.

The slot 30, known from the prior art (see FIG. 2), with a width in the vicinity of 1 mm, necessary to mount the ring 9 in the groove 6 of the disc 1, to allow closing of the ring 9, is replaced in the present invention by an opening 14, 15 with a larger width, for example 5 mm, allowing closing and a more significant decrease in the outer diameter of the ring 11, 12, thereby facilitating the successive placement of each ring 11, 12 in the groove 6. This easier assembly is a first advantage in relation to the known solutions of the prior art.

Another advantage of the invention is obtained by the fact that it is no longer necessary to master generally small assembly and operating play, between the support faces of the brace 13, 16 and the lateral faces of the hooks 5 cooperating in the rotating stop of the axial retaining device, unlike the solutions known from the prior art. The production tolerances of the brace 13, 16 and the width tolerances of the opening of each ring 11, 12, for example in the vicinity of +/−0.5 mm, are greater than the production tolerances of the solutions of the prior art.

The angular sector of the double ring 10, corresponding to the opening of one of the rings 11, 12, also ensures the function of axial maintenance of a vane 8, the openings never being facing each other on the two rings 11, 12. The axial retention efforts of the vanes 8 cannot, regardless of the phases or operating temperature variations of the turbomachine, cause the free ends of one of the rings 11, 12 to disengage outside the slot 6.

Moreover, the brace 13 of the first ring 11 cooperates with the lateral faces of the non-machined hooks 5 of the disc 1, to ensure the rotating stop of the double ring 10 while allowing a rotation of small amplitude, for example less than 3°, so as to maintain a position of the opening of the first 11 and second ring 12 between two feet of successive mobile vanes 8.

Another advantage of the invention is obtained with the possibility of dividing the closing efforts of the rings 11, 12 in half during their placement in the slot relative to a single ring with the same axial retention capacity as the double ring 10 presented above. Each ring 11, 12 is successively inserted in the groove formed by the hooks 5 at the end of the teeth 3.

The invention claimed is:

1. A device for axial retention of mobile vanes, configured to be inserted into a discontinuous groove of a turbomachine rotor disc, comprising:

two rings, superimposed, each including an opening separating free ends of the ring, wherein at least the first ring includes a rotating stop means, provided to engage in the opening of the second ring such that the two rings form a double ring.

2. The device according to claim 1, wherein the two rings have a same width, same thickness, and identical outer diameter.

3. The device according to claim 1, wherein the rotating stop means protrudes outwardly, in a radial direction of the first ring.

4. The device according to claim 1, wherein the rotating stop means of the first ring includes a brace formed by a tab, bent, folded down and fixed on a face of the first ring.

5. The device according to claim 1, wherein the rotating stop means includes a brace machined in an oversize of the first ring.

6. The device according to claim 4, wherein the brace of the first ring includes an inter-tooth lug for stopping rotation, protruding radially toward the outside of the first ring.

7. The device according to claim 5, wherein the inter-tooth lug has a thickness equal to twice that of the rest of the ring.

8. The device according to claim 1, wherein the brace and the opening of the first ring are angularly spaced by an angle greater than 150°.

9. The device according to claim 1, wherein the second retaining ring also includes a rotating brace stop.

10. A turbomachine rotor comprising:

at least one rotor disc whereof a body includes a plurality of slots and teeth including at least one hook, protruding in the axial direction of the disc, which defines, on that tooth, an elementary groove opening radially inwardly, a foot of a vane being inserted into the slot, wherein the foot is stopped in translation in the slot by at least one axial retaining device placed in a discontinuous groove, formed by a succession of elementary grooves, according to claim 1.

11. A turbomachine comprising a rotor as defined in claim 10.

* * * * *